US006571683B2

(12) United States Patent
Huber et al.

(10) Patent No.: US 6,571,683 B2
(45) Date of Patent: Jun. 3, 2003

(54) HYDRAULIC CYLINDER

(75) Inventors: Gerhard Huber, Frankenhofen (DE); Klaus Schweiger, Steingaden (DE)

(73) Assignee: Hoerbiger Hydraulik GmbH, Schongau (DE)

( * ) Notice: Subject to any disclaimer, the term of this patent is extended or adjusted under 35 U.S.C. 154(b) by 0 days.

(21) Appl. No.: 09/962,806

(22) Filed: Sep. 26, 2001

(65) Prior Publication Data

US 2002/0066365 A1 Jun. 6, 2002

(30) Foreign Application Priority Data

Oct. 13, 2000 (AT) ..... 1753/2000

(51) Int. Cl.[7] ..... F01B 31/00
(52) U.S. Cl. ..... 92/163; 285/136.1; 285/289.1
(58) Field of Search ..... 92/163, 164; 285/136.1, 285/141.1, 137.11, 289.1

(56) References Cited

U.S. PATENT DOCUMENTS 2,145,384 A * 1/1939 Allin ..... 92/163
2,533,531 A * 12/1950 Stephens ..... 92/164
2,886,005 A * 5/1959 Bryan ..... 92/163 X
3,418,888 A * 12/1968 Mercier ..... 92/164 X
3,655,017 A * 4/1972 Lorcher et al. ..... 285/289.1 X
H000155 H * 11/1986 Childress ..... 92/163 X
5,975,586 A * 11/1999 Pradel ..... 285/136.1 X

* cited by examiner

*Primary Examiner*—Edward K. Look
*Assistant Examiner*—Michael Leslie
(74) *Attorney, Agent, or Firm*—Dykema Gossett PLLC

(57) ABSTRACT

A double-action hydraulic cylinder (3) is provided with an axially slidable piston between a front cover and a rear cover, whereby the piston may be coupled to an extreme load through a piston rod (4) and whereby the piston may be biased via connections (5) for a hydraulic medium at both sides with the hydraulic medium from an extreme pressure source. The connections (5) are attached to the cylinder barrel (6) by means of soldered joints to achieve a good surface finish and thereby also an optically appealing appearance together with a reliable mounting of the pressure connections.

5 Claims, 2 Drawing Sheets

HYDRAULIC CYLINDER

BACKGROUND OF THE INVENTION

1. Field of the Invention

The invention relates to a double-action hydraulic cylinder having in its cylinder barrel an axially slidable piston between a rear cover and a front cover whereby the piston may be coupled to an extreme load through a piston rod and whereby the piston may be biased via connections for a hydraulic medium at both sides with the hydraulic medium from an extreme pressure source. The invention additionally relates to an actuation arrangement for moving parts on vehicles, particularly for rear doors, trunk lids or engine covers, convertible tops or covers for convertible top storage compartments including at least one double-action hydraulic cylinder arranged between two vehicle components to be moved against one another, an extreme pressure source for the hydraulic medium, and a control unit.

2. The Prior Art

Various methods have been used for hydraulic cylinders to secure connections through which the hydraulic medium is supplied to the working chambers. These connections are in most cases welded to the cylinder barrel and at times there are studs provided that have borings, which are attached to the cylinder barrel by stud welding and onto which hydraulic hoses are fitted, possibly removable. These welded connections are often times not very good in their surface finish or their appearance and reliability, which is of importance especially during operation when the hydraulic cylinder becomes often visible, for instance in vehicles with automatically movable rear doors or trunk lids, convertible systems and the like.

The object of the present invention was therefore to provide a hydraulic cylinder that has a good surface finish and thereby also an optically appealing appearance together with a reliable mounting of the pressure medium connections. An additional object was to provide an actuation arrangement as described in the beginning, which offers these advantages as well.

SUMMARY OF THE INVENTION

To achieve the first object, the double-action hydraulic cylinder is characterized in that the connections are attached to the cylinder barrel by means of a soldered joint. This soldered joint guarantees, on one hand, great reliability of the mounting and, on the other hand, is advantageous in its appearance.

According to an additional characteristic of the invention, the connections are fitted on the cylinder barrel by means of a centering sleeve. During manufacturing, good temporary attachment of the connection to the cylinder barrel can be guaranteed and the transverse load on the connection is decreased thereby in the final product, which contributes additionally to the reliability of the chosen type of attachment.

A simple and rapid installation is achieved according to an additional characteristic of the invention in that the connections are provided with milled contact surfaces on the cylinder barrel.

To make a simpler and more economical production of hose connections possible, in another embodiment the connections are manufactured as a shaped piece having already a concave surface corresponding to the radius of the cylinder barrel, for instance in the form of an extrusion.

As a solution to the additional object, the actuation arrangement described in the beginning is characterized in that at least one of the hydraulic cylinders is designed according to the foregoing.

The invention will be explained in more detail in the following description with the aid of the accompanying drawings of illustrated embodiments.

DETAILED DESCRIPTION OF THE PREFERRED EMBODIMENTS

Figure 1:
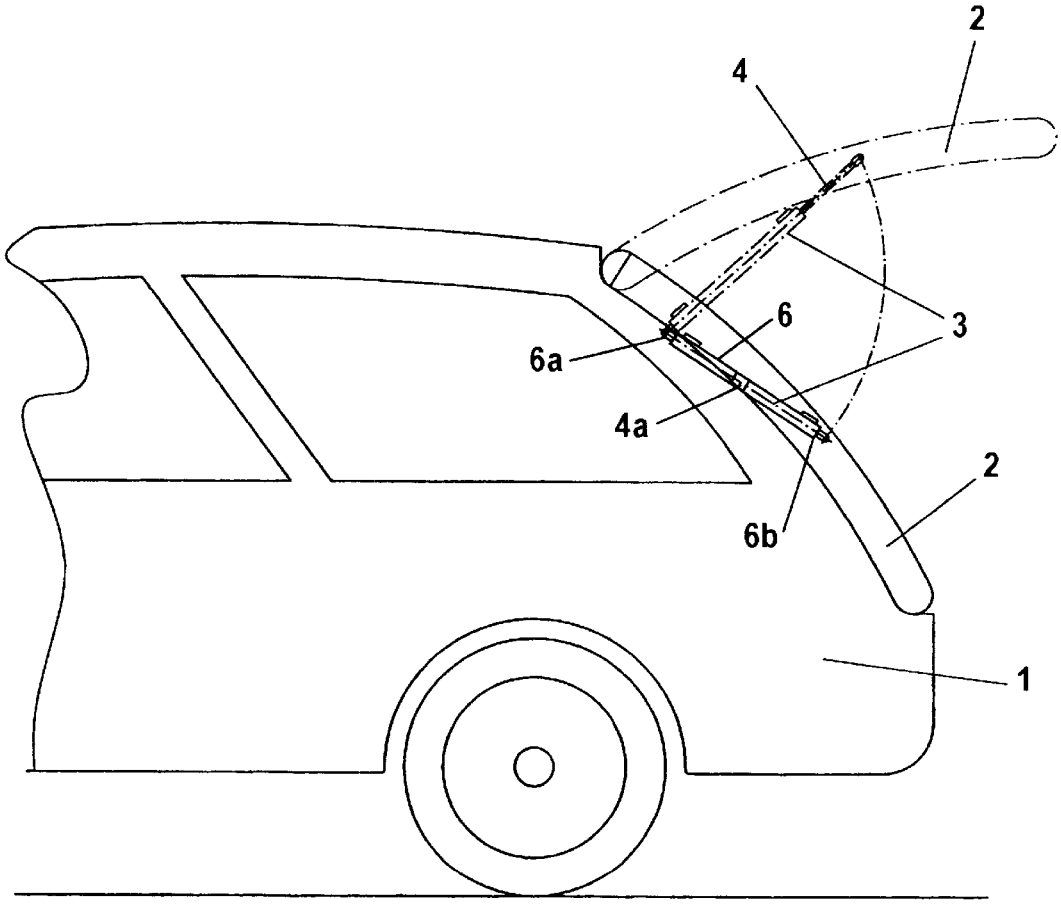
FIG. 1 shows a side view of a motor vehicle with a rear door that may be opened or closed by an actuation arrangement having a double-action hydraulic cylinder according to the invention.

At least one double-action cylinder is employed between body 1 of a motor vehicle and the upward swivelable read door 2. The pressure source for the hydraulic medium, its reservoir, or the control device (preferable control electronics) are not illustrated for reasons of simplification and because they are not an essential part of the invention. During opening of the rear door 2, the door is pushed upwardly from the position illustrated by solid lines through the force exerted by one or each hydraulic cylinder 3 whereby the piston rod 4 extends and the piston 4*a* moves within the hydraulic cylinder, such that the hydraulic cylinder 3 as well as the rear door 2 are moved into the position shown by dotted lines. The hydraulic cylinder includes a barrel 6 having opposite first and second end covers 6*a* and 6*b*, a piston 4*a* which moves within the barrel, and a piston rod 4 which extends through the second end 6*b*.

Figure 2A:
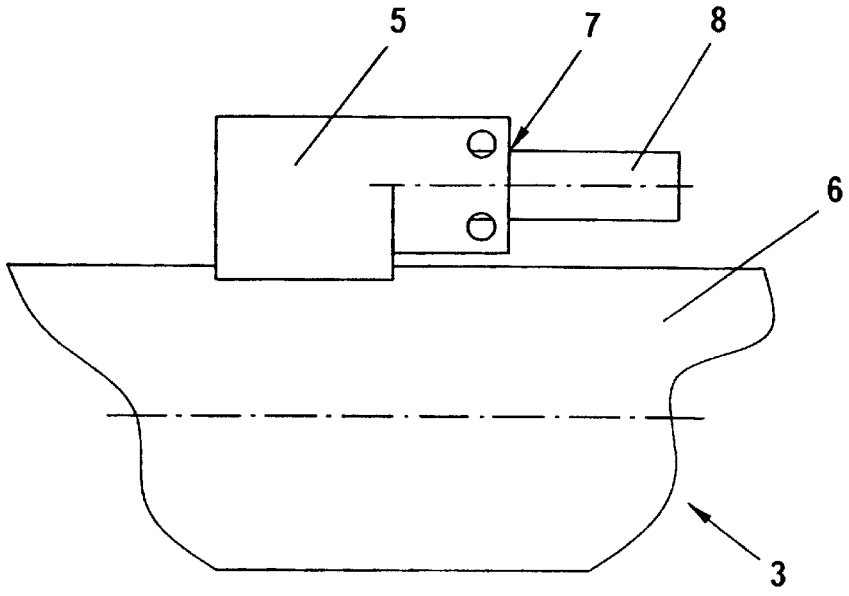
FIGS. 2*a* and 2*b* show a partial side view or a partial longitudinal section of a hydraulic cylinder having a soldered pressure connection according to an advantageous embodiment of the invention.

In FIG. 2*a* longitudinal section of the hydraulic cylinder is shown with a connection device 5 for the hydraulic medium mounted on its cylinder barrel 6 by means of a soldered joint. The end of a hydraulic line or of a hydraulic hose 8 may be inserted, preferably detachable, into a hose connection 7, which preferably may also be shaped by milling of the connection device 5 and whereby the end may be locked in position at the connection device 5. The connection device 5 has a concave surface 5*b* which corresponds with the curvature of the external surface 6*c* of the cylindrical barrel 6.

Figure 2B:
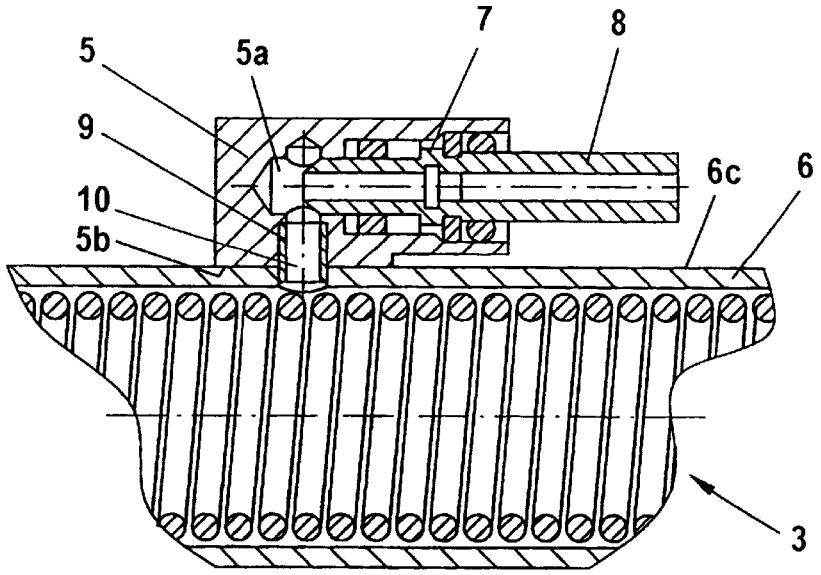

In the longitudinal section of FIG. 2*b* it can be seen that the connection device 5 may be held in place during the making of the soldered joint on the cylinder barrel 6 as well as in the completed hydraulic cylinder 3, preferably by means of a centering sleeve 9 oriented radially toward the cylinder barrel 6 and also oriented axially as well as in the circumferential direction of the cylinder barrel 6. The centering sleeve 9 is attached to the hydraulic cylinder before the mounting of the connection device 5, preferably pressed into an opening thereof, and it is then inserted into a simple boring in the cylinder wall during mounting of the connection device 5 onto the cylinder barrel 6. The centering sleeve 9 is preferably provided with an axial passage 10 through which the hydraulic medium may reach the interior of the cylinder barrel 6 from the hose 8 through the passageway 5*a* in the connection device 5.

We claim:

1. A double-action hydraulic cylinder which comprises:

a cylinder barrel having first and second end covers, a piston movable therein, and a piston rod attached to said piston and extending through said second end cover, said barrel including a radial side bore which communicates with an interior thereof, and a connection device soldered to an external side surface of said barrel at a location over said radial bore, said connection device including an opening in which an end of a hydraulic hose can be inserted and a passageway therethrough for conveying hydraulic medium from said hydraulic hose to said radial bore and into said cylinder barrel to affect movement of said piston therein.

2. The double-action hydraulic cylinder of claim 1, including a centering sleeve which fits within said radial bore and extends into said connection device to communicate with said passageway therein.

3. The double-action hydraulic cylinder of claim 1, wherein a surface of said connection device which faces said external surface of said barrel has a concave configuration which corresponds with a curvature of said external surface.

4. The double-action hydraulic cylinder of claim 3, wherein said concave surface of said connection device and said external surface of said barrel which faces said connection device are milled.

5. The combination of a vehicle which includes a body and a part which is movable relative to the body and a double-action hydraulic cylinder connected between said body and said movable part, said double-action hydraulic cylinder being constructed as defined in claim 1.

* * * * *